United States Patent [19]

Arzouman

[11] Patent Number: 4,697,788

[45] Date of Patent: Oct. 6, 1987

[54] MEANS FOR AUTOMATICALLY RELEASING A JACK SYSTEM

[75] Inventor: Harry H. Arzouman, Los Angeles, Calif.

[73] Assignee: Safe-T-Jack, Inc., Irvine, Calif.

[21] Appl. No.: 859,462

[22] Filed: May 5, 1986

[51] Int. Cl.[4] ..... B66F 5/04

[52] U.S. Cl. ..... 254/8 B

[58] Field of Search ..... 74/533, 534, 535; 248/354.7; 414/427; 254/133 R, 134, 7 B, 8 B, 2 B, 89 R, 89 M, DIG. 1, DIG. 4, 1

[56] References Cited

U.S. PATENT DOCUMENTS

| | | | |
|---|---|---|---|
| 2,852,229 | 9/1958 | Gross | 254/134 |
| 3,709,467 | 1/1973 | Mann | 254/45 |
| 3,834,669 | 9/1974 | Reid | 254/133 |
| 4,066,243 | 1/1978 | Johnson | 254/133 |
| 4,251,056 | 2/1981 | Maniglia | 254/8 B |
| 4,289,299 | 9/1981 | Kameda | 254/8 B |
| 4,462,569 | 7/1984 | Arzouman | 254/89 R |
| 4,553,727 | 11/1985 | Arzouman | 254/1 |
| 4,589,630 | 5/1986 | Arzouman | 254/89 R |

*Primary Examiner*—Robert C. Watson

*Attorney, Agent, or Firm*—Gene W. Arant; Matthew F. Jodziewicz

[57] ABSTRACT

In an exemplary embodiment in a two-part jack system which includes a jack stand having a load-bearing member supported from vertically telescoping members, one of which has ratchet teeth and another of which carries a spring-loaded pawl for selectively engaging the ratchet teeth, and a power unit having arms for directly supporting the load-bearing member in order to extend or retract the jack stand, the invention is directed to an automatic release mechanism operable when the power unit is being utilized to retract the jack stand for disengaging the pawl from the ratchet to thereby permit complete retraction of the jack stand in a single movement and comprises: an extension arm on the pawl; a pusher member carried on the power unit for selectively engaging the extension arm so as to cause the pawl to disengage from the ratchet teeth; spring means urging the pusher member towards the extension arm; means coupled to the pusher member for selectively restraining its movement; and restraining means being adapted to be selectively disabled whenever the power unit is utilized for retracting the jack stand.

6 Claims, 2 Drawing Figures

MEANS FOR AUTOMATICALLY RELEASING A JACK SYSTEM

CROSS REFERENCES TO RELATED APPLICATIONS

The present invention is related to those two part jacking systems disclosed in U.S. Pat. No. 4,462,569, issued July 31, 1984, and U.S. Pat. No. 4,589,630, to be issued May 20, 1986, both to the same inventor herein.

BACKGROUND OF THE INVENTION

1. Field of the Invention

This invention relates generally to means for automatically releasing a jack support member for lowering the same, and more particularly to an automatic release mechanism operable with a two-part jack system having a jack stand and a power unit.

2. Description of the Related Art

The two part jacking system in which the present invention is best used is best described in U.S. Pat. Nos. 4,462,569 and 4,589,630.

Briefly, the two part jacking system consists of a power unit and a set of separate mechanical jack stands. The stands are capable of being vertically extended and retracted and, when extended, can be locked in place at any desired position by a ratchet and pawl assembly. The chassis of the power unit is adapted to mate with and carry the jack stands for placement or removal.

In use, the power unit is operated entirely from its handle. It is maneuvered under a vehicle to place the jack stand in the desired location for lifting and supporting the vehicle. The power unit, activated from the handle, then vertically extends this jack stand to the desired height thus lifting the vehicle on the stand. By operating the controls at the end of the handle, the operator can cause the power unit to disengage from the stand, which will remain locked in its extended supporting position under the vehicle. In this manner, the vehicle is raised and supported on a separate mechanical stand without transferring the vehicle from a jack to a stand and without the operator placing any part of his body under the vehicle or having to touch the stand itself. After the stand is raised and locked in place to support the vehicle or other load in a lifted position, the power unit lift arm is lowered and the power unit is disengaged from the stand and pulled away, leaving the stand in position supporting the load.

To lower the vehicle and remove the stand, the power unit is maneuvered to re-engage with the stand. By manually operating a control at the end of the handle, the user can cause the power unit to re-engage with the stand, disengage the ratchet locking system of the stand and lower the stand to its original position. The power unit remains engaged with the stand and can be pulled away from the vehicle with the stand carried in its chassis.

This prior art system however, requires manual intervention by the user to disengage the ratchet locking system of the stand at the proper moment when the loading forces on the stand are transferred to the lifting arm of the power unit. As the stand is remote from the user, the determination of the proper timing to disengage the ratchet locking system is difficult and may, in some instances, force the user to place himself under the vehicle or to touch the stand to determine when the loading forces are removed from the stand by action of the lifting arms of the power unit. This situation obviates the safety features of the two part jacking system and subjects the user to the possibility of a serious accident.

The present invention overcomes this prior art problem by providing a mechanism for automatically releasing the stand when the loading forces on the stand are removed by the lifting arms of the power unit. Thus, the safety features of the two-part jack system that permit the raising and lowering of a vehicle or other load without a user having to place any part of his body under the vehicle or other load, are preserved.

SUMMARY OF THE INVENTION

It is an object of the present invention to provide a mechanism for use with two-part jack systems operable when the power unit is being utilized to retract the jack stand for automatically disengaging the locking mechanism of the jack stand whenever the loading forces on the jack stand are removed by the lifting arms of the power unit.

In an exemplary embodiment in a two-part jack system which includes a jack stand having a load-bearing member supported from vertically telescoping members, one of which has ratchet teeth and another of which carries a spring-loaded pawl for selectively engaging the ratchet teeth, and a power unit having arms for directly supporting the load-bearing member in order to extend or retract the jack stand, the invention is directed to an automatic release mechanism operable when the power unit is being utilized to retract the jack stand for disengaging the pawl from the ratchet to thereby permit complete retraction of the jack stand in a single movement, and comprises: an extension arm on the pawl; a pusher member carried on the power unit for selectively engaging the extension arm so as to cause the pawl to disengage from the ratchet teeth; spring means urging the pusher member towards the extension arm; means coupled to the pusher member for selectively restraining its movement, and the restraining means being adapted to be selectively disabled whenever the power unit is utilized for retracting the jack stand.

These and other objects of the invention will become more apparent from the hereinafter following commentary taken in conjunction with the following Figures of Drawings.

DESCRIPTION OF THE PREFERRED EMBODIMENTS

Figure 1:
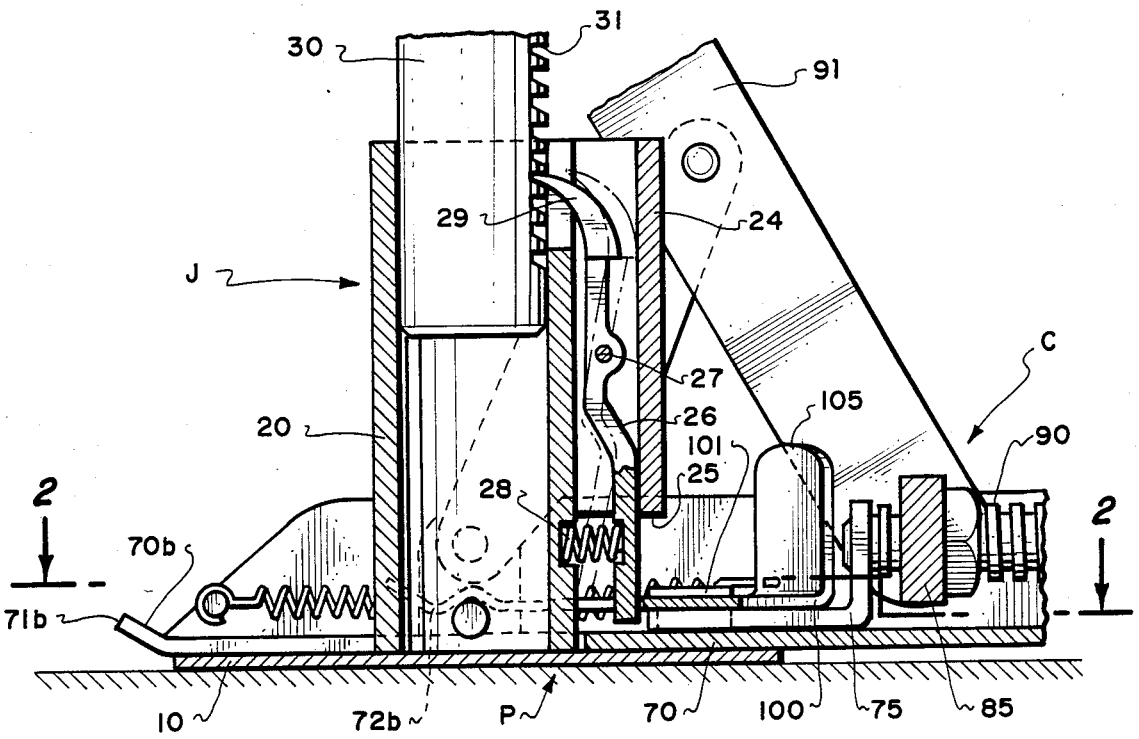
FIG. 1 is a side cross-sectional view of a two-part jack system embodying the invention.
Figure 2:
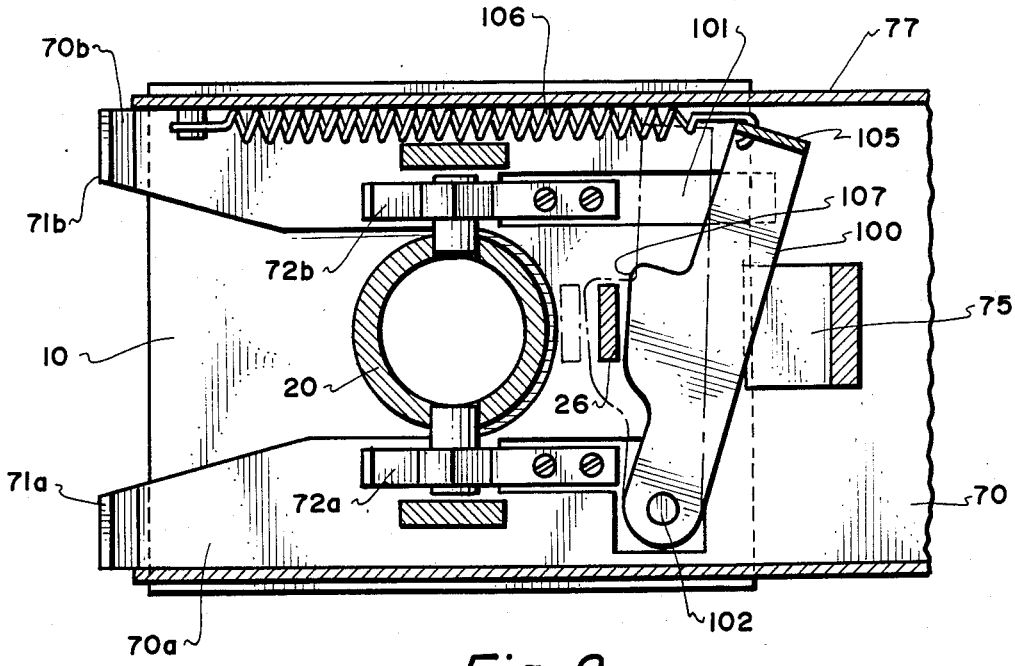
FIG. 2 is a view taken along line 2—2 of FIG. 1.

Referring to the Figures of Drawings wherein like numbers of reference designate like elements throughout, it will be noted that a preferred embodiment of the invention for use in a two-part jack system is illustrated in FIGS. 1 and 2. In general, the apparatus includes a jack stand J, a power unit P, and a drive crank C. For simplification, only the elements forming the invention or interacting with the invention will be described.

Jack stand J includes a flat bottom plate 10 which is adapted to rest upon any supporting surface such as a street or pavement. A tube 20 extends vertically upward from plate 10, its lower end being secured to the plate as by welding.

A ratchet housing 24 is attached to tube 20 adjacent one end of the bottom plate 10. The cross section of housing 24 is best seen in FIG. 2. Housing 24 has a window 25 cut near its lower end. A ratchet or latch plate 26 is positioned inside the ratchet housing and is pivotally supported inside the housing by means of a horizontal pivot pin 27 as shown. The lower end of ratchet plate 26 is exposed through the window 25. A compression spring 28 extends horizontally between the lower end of the ratchet plate 26 and the outer wall surface of tube 20, its ends being retained in recesses in both of those members.

A vertical shaft 30 has its lower end received within the tube 20. Ratchet teeth 31 formed on the shaft 30 are shown in side view in FIG. 1 and in horizontal cross-section in FIG. 2. A ratchet tooth or dog 29 formed on the upper end of ratchet plate 26 engages one of the teeth 31. Although not specifically shown in the drawings, the upper end of shaft 30 contains a threaded opening for receiving and supporting an extension shaft.

A top plate is secured to the upper end of shaft 30 as by welding. It will therefore be understood that tube 20 and shaft 30 form a pair of telescoping members as commonly known in the prior art, with the bottom plate 10 and top plate being at the lower and upper ends, respectively, of the telescoping members.

Power unit P also appears in FIGS. 1 and 2. It includes an elongated flat bottom plate 70 which is of slightly less width than bottom plate 10 of the jack stand, but is much longer. The forward end of bottom plate 70 is bifurcated to form legs 70*a* and 70*b*. The legs are tapered at their forward inner edges and have their ends upturned to form lifts 71*a* and 71*b* respectively.

Drive crank C is comprised of drive screw 90 rotatably journaled in plate 75 and passes through a threaded opening in the scissors drive plate 85 and connected to lifting arm 91. The remaining elements of drive crank C are not illustrated, but are as commonly understood in the prior art of scissors drive lifting arms and are eliminated herein for simplicity of illustration.

A ratchet trip member 100 is normally held in a restrained position by a retaining block 101. Block 101 is immediately to the rear of spring 72*b* and secured in fixed position on bottom plate 70. A pivot pin 102 located immediately behind the other alignment spring 72*a* secures one end of trip member 100 in horizontally pivotal relation to the bottom plate. The other end of trip member 100 has an upturned handle portion 105. A tension spring 106 is connected between the trip handle 105 and the forward end of bottom plate leg 70*b*. Trip member 100 is secured rather loosely at the location of pivot pin 102. It is therefore possible to raise handle 105 slightly, so that the trip member clears the upper surface of block 101. Tension spring 106 then pulls the trip member forward, causing its mid-portion 107 to come into hard engagement with the exposed lower end of ratchet plate 26. See FIG. 2 where the position of engagement is shown in dotted lines. It will be seen that plate 75 is located to the rear of trip member 100 and does not interfere with its movement. As shown in FIG. 1, the ratchet plate then assumes its dotted line position and releases its support of shaft 30, if the jack stand does not have a loading force on it.

The biasing force exerted by tension spring 106 must, of course, be chosen to provide sufficient biasing force to release ratchet member 26 from ratchet teeth 31 only when loading forces are removed from jack stand J, but not sufficient to overcome the combined forces of the load and of compression spring 28 retaining ratchet member 26 in engagement with ratchet teeth 31.

Ratchet trip member 100 may be remotely actuated between its restrained and its released positions by mechanical linkage or cable control means having its control point located on a handle of the power unit for ease in user operation of the mechanism.

The invention as embodied in a two-part jack system and described above operates as follows:

In raising the stand, ratchet trip member 100 is restrained behind restraining block 101 by the user prior to inserting power unit P into engagement with jack stand J. In this restrained position, ratchet trip member 100 will not engage the exposed lower end of ratchet plate 26 and thus the ratchet locking mechanism is in position to lock and retain jack stand J in its elevated position.

In lowering the stand, ratchet trip member 100 is raised by the user over restraining block 101 prior to inserting power unit P into engagement with jack stand J. In this unrestrained position, ratchet trip member 100 will engage the exposed lower end of ratchet plate 26 and thus, once the loading forces are removed from stand J, move ratchet plate 26 outward into its unlocking position. It is important to note that such movement cannot occur until the loading forces are removed from jack stand J by the lifting arms of the power unit and that such action is automatic once ratchet trip member 100 is released from engagement with restraining block 101. Thus, the user need only set the ratchet trip member 100 and it will automatically move the ratchet plate member from its locked to unlocked position once the loading forces on the stand are removed by the lifting arms of the power unit P. No further action is required by the user of the two-part jack system.

The invention described above is, of course, susceptible to many variations, modifications and changes, all of which are within the skill of the art. It should be understood that all such variations, modifications, and changes are within the spirit and scope of the invention and of the appended claims. Similarly, it will be understood that it is intended to cover all changes, modifications, and variations of the example of the invention herein disclosed for the purpose of illustration which do not constitute departures from the spirit and scope of the invention.

I claim:

1. In a two-part jacking system including an extendible jack stand having a flat base plate, a hollow frame secured to said base plate, a vertical shaft having ratchet teeth formed thereon adapted for telescoping movement within said frame, a vertically disposed pawl assembly pivotally supported within said frame and selectively engageable with said ratchet teeth of said vertical shaft to lock said shaft in a selected elevational position relative to said base plate or to release said shaft from such position, the lowermost end of said pawl assembly extending downward and being exposed so that a force may be applied thereto for releasing said pawl assembly from said ratchet teeth, and a power unit adapted to be aligned with and releasably attached to said jack stand for selectively raising and lowering said jack stand;

means for automatically releasing said pawl assembly from said ratchet teeth for lowering said vertical shaft when loading forces are removed from said vertical shaft, comprising:

a pusher member supported from said power unit and aligned to selectively engage said lowermost end of said pawl assembly:

means operatively connected to said pusher member for biasing said pusher member against said lowermost end of said pawl assembly and adapted to drive said lowermost end of said pawl assembly to release said pawl assembly from said ratchet teeth when said loading forces are removed from said vertical shaft; and, means operatively connected to said pusher member for selectively restraining and releasing said pusher member from engaging said lowermost end of said pawl assembly.

2. A device as claimed in claim 1 wherein said means for biasing said pusher member against said lowermost end of said pawl assembly comprises a spring operatively connected between said pusher member and said power unit to naturally bias said pusher unit into engagment with said lowermost end of said pawl assembly.

3. A device as claimed in claim 2 wherein said means for selectively restraining and releasing said pusher member from engaging said lowermost end of said pawl assembly comprises a protuberance formed on said power unit and located and shaped for engaging said pusher member in a selectively releasable abutting relationship.

4. In a two-part jack system which includes a jack stand having a load-bearing member supported from vertically telescoping members, one of which has ratchet teeth and another of which carries a spring-loaded pawl for selectively engaging the ratchet teeth, and a power unit having arms for directly supporting the load-bearing member in order to extend or retract said jack stand;

an automatic release mechanism operable when said power unit is being utilized to retract said jack stand, for disengaging said pawl from said ratchet to thereby permit complete retraction of said jack stand in a single movement, comprising:

an extension arm on said pawl;

a pusher member carried on said power unit for selectively engaging said extension arm so as to cause said pawl to disengage from said ratchet teeth;

spring means urging said pusher member towards said extension arm;

means coupled to said pusher member for selectively restraining its movement; and, said restraining means being adapted to be selectively disabled whenever said power unit is utilized for retracting said jack stand.

5. A device as claimed in claim 4 wherein said means for selectively restraining said pusher member from engaging said extension arm comprises a protuberance formed on said power unit and located and shaped for engaging said pusher member in a selectively releasable abutting relationship.

6. A system of jacking apparatus comprising:

a jack stand including a base portion and a telescoping vertical stand, said telescoping stand having a vertically extending series of ratchet teeth carried thereon, a vertically extending ratchet arm pivotally supported at a mid-point along its length from said base portion, a ratchet pawl on the upper end of said ratchet arm, and a ratchet locking spring interposed between said base portion and said ratchet arm and urging said ratchet arm to move pivotally relative to said jack stand base portion in a direction such as to cause said pawl to lockingly engage one of said teeth;

a power unit adapted to be removably attached to said jack stand in aligned relationship thereto whenever said jack stand is to be extended or retracted, said power unit having lifting means selectively operable during times when said power unit is thus attached for supporting and raising said telescoping stand;

automatic release means carried by said power unit, and selectively operable whenever said power unit is attached to said jack stand and it is desired to retract said jack stand, for applying a spring force against the lower end of said ratchet arm in a direction such as to unlock said pawl; and the spring force of said automatic release means being insufficient to overcome said ratchet locking spring when a vertical load carried upon said telescoping frame locks the ratchet pawl to one of the ratchet teeth, but being more than sufficient to do so when there is no vertical load on said telescoping frame;

whereby when said jack stand is to be retracted, said power unit may first be attached thereto, said power unit lifting means may then be operated for raising said telescoping stand to remove the load forces from the pawl, upon the lifting of the load said automatic release means will then overcome said ratchet locking spring thereby causing said pawl to unlock from said ratchet teeth, and said lifting means may then be operated in reverse so as to retract said jack stand.

* * * * *